US008172497B2

(12) United States Patent
Orgeron et al.

(10) Patent No.: US 8,172,497 B2
(45) **Date of Patent: *May 8, 2012**

(54) RAISE-ASSIST AND SMART ENERGY SYSTEM FOR A PIPE HANDLING APPARATUS

(75) Inventors: Keith J. Orgeron, Houston, TX (US); Axel M. Sigmar, Houston, TX (US)

(73) Assignee: T & T Engineering Services, Tomball, TX (US)

( * ) Notice: Subject to any disclaimer, the term of this patent is extended or adjusted under 35 U.S.C. 154(b) by 346 days.

This patent is subject to a terminal disclaimer.

(21) Appl. No.: 12/418,302

(22) Filed: Apr. 3, 2009

(65) Prior Publication Data

US 2010/0254784 A1 Oct. 7, 2010

(51) Int. Cl.
*E21B 19/18* (2006.01)
*B23P 19/10* (2006.01)

(52) U.S. Cl. ..... 414/22.55; 414/913; 901/48; 212/180; 212/195

(58) Field of Classification Search ..... 212/195, 212/280; 414/22.51–22.59, 601–602, 673, 414/719, 913; 901/48
See application file for complete search history.

(56) References Cited

U.S. PATENT DOCUMENTS

| | | | | |
|---|---|---|---|---|
| 62,404 A | | 2/1867 | Gile et al. | |
| 184,168 A | | 11/1876 | Nickle | |
| 514,715 A | | 2/1894 | Jenkins | |
| 1,249,194 A | | 12/1917 | Race | |
| 1,264,867 A | | 4/1918 | Schuh | |
| 1,312,009 A | | 8/1919 | Thrift | |
| 1,318,789 A | | 10/1919 | Moschel | |
| 1,369,165 A | * | 2/1921 | Cochran et al. | 414/494 |
| 2,124,154 A | | 7/1937 | Sovincz | |
| 2,327,461 A | | 8/1943 | Rowe | |
| 2,382,767 A | | 8/1945 | Zeilman | |
| 2,497,083 A | | 2/1950 | Hildebrand | |
| 2,535,054 A | | 12/1950 | Ernst et al. | |
| 2,592,168 A | | 8/1952 | Morris et al. | |
| 2,715,014 A | | 8/1955 | Garnett et al. | |

(Continued)

FOREIGN PATENT DOCUMENTS

EP 0 024 433 A1 3/1981

(Continued)

OTHER PUBLICATIONS

U.S. Appl. No. 11/923,451, filed Oct. 24, 2007, Keith J. Orgeron.

(Continued)

*Primary Examiner* — Gregory Adams
(74) *Attorney, Agent, or Firm* — John G. Fischer; Scheef & Stone, L.L.P.

(57) ABSTRACT

An apparatus for pivoting a boom relative to a frame of a pipe handling system between a first position and a second position has a hydraulic actuator assembly connected to the boom and to the skid, and a pneumatic spring connected to the boom and to the skid. The pneumatic spring has a cylinder with an end pivotally connected to the boom, and a piston with an end pivotally connected to the skid. The hydraulic actuator assembly has a cylinder pivotally connected to the skid, and a piston with an end pivotally connected to the boom. The pneumatic spring urges the boom from the first position toward the second position while resisting movement of the boom from the second position toward the second position.

24 Claims, 5 Drawing Sheets

U.S. PATENT DOCUMENTS 2,770,493 A 11/1956 Fieber
2,840,244 A * 6/1958 Thomas, Jr. ..... 212/280
3,059,905 A 10/1962 Tompkins
3,076,560 A * 2/1963 Bushong et al. ..... 212/298
3,177,944 A 4/1965 Knights
3,262,593 A 7/1966 Hainer
3,280,920 A 10/1966 Scott
3,331,585 A 7/1967 Dubberke
3,365,762 A 1/1968 Spiri
3,464,507 A 9/1969 Alexander et al.
3,561,811 A 2/1971 Turner, Jr.
3,633,771 A 1/1972 Woolslayer et al.
3,702,640 A 11/1972 Cintract et al.
3,703,968 A 11/1972 Uhrich et al.
3,806,021 A 4/1974 Moroz et al.
3,823,916 A 7/1974 Shaw
3,848,850 A 11/1974 Bemis
3,860,122 A 1/1975 Cernosek
3,963,133 A 6/1976 Gilli
3,986,619 A 10/1976 Woolslayer et al.
3,991,887 A 11/1976 Trout
3,995,746 A 12/1976 Usagida
4,011,694 A 3/1977 Langford
4,030,698 A 6/1977 Hansen
4,044,952 A 8/1977 Williams et al.
4,142,551 A * 3/1979 Wilms ..... 137/615
4,158,283 A 6/1979 Nation
4,172,684 A 10/1979 Jenkins
4,276,918 A 7/1981 Sigouin
4,277,044 A * 7/1981 Hamilton ..... 248/571
4,303,270 A 12/1981 Adair
4,336,840 A 6/1982 Bailey
4,403,666 A 9/1983 Willis
4,403,897 A 9/1983 Willis
4,407,629 A 10/1983 Willis
4,420,917 A 12/1983 Parlanti
4,440,536 A 4/1984 Scaggs
4,492,501 A 1/1985 Haney
4,529,094 A 7/1985 Wadsworth
4,547,110 A 10/1985 Davidson
4,595,066 A 6/1986 Nelmark et al.
4,650,237 A 3/1987 Lessway
4,658,970 A * 4/1987 Oliphant ..... 212/294
4,688,983 A * 8/1987 Lindbom ..... 414/735
4,708,581 A 11/1987 Adair
4,756,204 A * 7/1988 Wittwer et al. ..... 74/469
4,759,414 A 7/1988 Willis
4,765,225 A 8/1988 Birchard
4,765,401 A 8/1988 Boyadjieff
4,822,230 A 4/1989 Slettedal
4,834,604 A 5/1989 Brittain et al.
4,869,137 A 9/1989 Slator
5,060,762 A 10/1991 White
5,135,119 A 8/1992 Larkin
5,186,264 A 2/1993 Du Chaffaut
5,458,454 A 10/1995 Sorokan
5,597,987 A 1/1997 Gilliland et al.
5,609,226 A 3/1997 Penisson
5,649,745 A 7/1997 Anderson
5,660,087 A 8/1997 Rae
5,671,932 A 9/1997 Chapman
5,806,589 A 9/1998 Lang
5,848,647 A 12/1998 Webre et al.
5,964,550 A 10/1999 Blandford et al.
5,992,801 A 11/1999 Torres
5,993,140 A 11/1999 Crippa
6,003,598 A 12/1999 Andreychuk
6,158,516 A 12/2000 Smith et al.
6,220,807 B1 4/2001 Sorokan
6,234,253 B1 5/2001 Dallas
6,253,845 B1 7/2001 Belik
6,264,128 B1 7/2001 Shampine et al.
6,264,395 B1 7/2001 Allamon et al.
6,279,662 B1 8/2001 Sonnier
6,343,892 B1 2/2002 Kristiansen
6,398,186 B1 6/2002 Lemoine
6,431,286 B1 8/2002 Andreychuk
6,471,439 B2 10/2002 Allamon et al.
6,502,641 B1 1/2003 Carriere et al.
6,543,551 B1 4/2003 Sparks et al.
6,543,555 B2 4/2003 Casagrande
6,557,641 B2 5/2003 Sipos et al.
6,564,667 B2 * 5/2003 Bayer et al. ..... 74/490.01
6,609,573 B1 8/2003 Day
6,705,414 B2 3/2004 Simpson et al.
6,745,646 B1 6/2004 Pietras et al.
6,748,823 B2 6/2004 Pietras
6,779,614 B2 8/2004 Oser
6,814,149 B2 11/2004 Liess et al.
6,845,814 B2 1/2005 Mason et al.
7,028,585 B2 4/2006 Pietras et al.
7,055,594 B1 6/2006 Springett et al.
7,077,209 B2 7/2006 McCulloch
7,090,035 B2 8/2006 Lesko
7,090,254 B1 8/2006 Pietras et al.
7,117,938 B2 10/2006 Hamilton et al.
7,121,166 B2 10/2006 Drzewiecki
7,172,038 B2 2/2007 Terry et al.
7,289,871 B2 10/2007 Williams
7,398,833 B2 7/2008 Ramey et al.
7,438,127 B2 10/2008 Lesko
7,726,929 B1 6/2010 Orgeron
7,918,636 B1 * 4/2011 Orgeron ..... 414/22.55
2002/0070187 A1 6/2002 Willim
2003/0221871 A1 12/2003 Hamilton et al.
2008/0253866 A1 10/2008 Lops et al.
2009/0232624 A1 9/2009 Orgeron
2010/0032213 A1 2/2010 Orgeron
2010/0034619 A1 2/2010 Orgeron
2010/0034620 A1 2/2010 Orgeron
2010/0187740 A1 7/2010 Orgeron
2010/0254784 A1 * 10/2010 Orgeron et al. ..... 414/22.55

FOREIGN PATENT DOCUMENTS

WO 93/15303 A1 8/1993
WO 2006/038790 A1 4/2006

OTHER PUBLICATIONS

U.S. Appl. No. 12/371,593, filed Feb. 14, 2009; non-published; titled "Pipe Handling Apparatus With Stab Frame Stiffening" and having a common inventor with the present patent application.

* cited by examiner

RAISE-ASSIST AND SMART ENERGY SYSTEM FOR A PIPE HANDLING APPARATUS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the delivery of tubulars from a horizontal orientation to a vertical orientation at a well head. Particularly, the present invention relates to pipe handling apparatus that position tubulars at a well head. More particularly, the present invention relates to device for assisting a pivotal movement of a boom relative to a base of a pipe handling apparatus.

2. Description of Related Art Including Information Disclosed Under 37 CFR 1.97 and 37 CFR 1.98

Drill rigs have utilized several methods for transferring tubular members from a pipe rack adjacent to the drill floor to a mousehole in the drill floor or the well bore for connection to a previously transferred tubular or tubular string. The term "tubular" as used herein includes all forms of pipe, drill pipe, drill collars, casing, liner, bottom hole assemblies (BHA), and other types of tubulars known in the art.

Conventionally, drill rigs have utilized a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table at the well head. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

In the past, various devices have been created which mechanically move a pipe from a horizontal orientation to a vertical orientation such that the vertically-oriented pipe can be installed into the well bore. Typically, these devices have utilized several interconnected arms that are associated with a boom. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary to as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

To address these problems and needs, U.S. application Ser. No. 11/923,451, filed on Oct. 24, 2007 by the present applicant, discloses a pipe handling apparatus that has a boom pivotally movable between a first position and a second position, a riser assembly pivotally connected to the boom, an arm pivotally connected at one end to the first portion of the riser assembly and extending outwardly therefrom, a gripper affixed to a opposite end of the arm suitable for gripping a diameter of the pipe, a link pivotally connected to the riser assembly and pivotable so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion.

The pipe handling apparatus delivers a pipe to a well head when in the second position. Pipes can be of extraordinary lengths and weights. The boom of the above pipe handling apparatus is pivotally connected to a skid so as to pivot between the first and second positions. Pipes can be of extraordinary lengths and weights; therefore, the pivotal connection between the boom and skid must be strong so as to withstand the forces created by the movement of the boom between the first and second positions. Typically, hydraulic cylinders are placed between the boom and skid so as to raise and lower the boom between the first and second positions. The hydraulic cylinders are connected to a hydraulic power system so as to raise and lower the boom between the first and second positions. Through use of the above-discussed pipe handling apparatus, it was found that large amounts of power are needed for certain portions of the power band of the stroke of the hydraulic cylinders. That is, the power requirements for extending the hydraulic cylinders so as to move the boom between the first and second positions is not uniform for the entire movement of the hydraulic cylinders. Thus, there is a need to make the power band of the hydraulic cylinders more uniform across the entire length of travel of the hydraulic cylinders. Moreover, there is a need to reduce the total energy required to move the boom between the first and second positions.

Various patents have issued relating to the movement of a boom of a pipe handling apparatus with hydraulic cylinders or other similar means. For example, U.S. Pat. No. 7,077,209, issued on Jul. 18, 2006 to McCulloch, discloses a mast for lifting and suspending a coiled tubing injector and blowout preventer over a well head that is pivotally mounted on a rear portion of a truck. The mast has two side-by-side telescoping legs that extend and retract synchronously. Hydraulic cylinders pivotally move the mast between a lower position and an upper position.

U.S. Pat. No. 4,336,840, issued on Jun. 29, 1982 to Bailey, discloses a suspension system for use with a mast. The system has two or more fluid pressure piston-and-cylinder assemblies. The cylinders are linked in pairs so that retraction of both piston rods reduces the length of the pair of assemblies to the length of a single assembly. Operation of both pistons in a pair provides an effective stroke twice the length of a single assembly stroke. In a particular embodiment, a double-cylinder system is used as a pickup system for elevating equipment along a mast in a well work over rig.

U.S. Pat. No. 7,289,871, issued on Oct. 30, 2007 to Williams, discloses a drilling apparatus that has a base from which a drilling arm is pivotally mounted. The drilling arm has an inner arm and an outer arm. The inner arm has a first end and a second end. The first end is pivotally connected by a first pivot joint to the base. The outer arm has a first end and a second end. The second end of the inner arm is pivotally connected via a second pivot joint to the first end of the outer arm. A drill-mounting assembly is positioned at the second end of the outer arm. Actuation of the inner and outer arms is achieved by hydraulic cylinders. Proper operation of the cylinders causes the second end of the outer arm to follow a substantially linear path.

U.S. Pat. No. 6,003,598, issued on Dec. 21, 1999 to Andrychuk, discloses a mobile hybrid rig adapted to run coiled tubing and wireline equipment for oil and gas wells. The rig has a chassis and power unit for transporting the rig. An adjustable platform with a number of hydraulically-operated stabilizers align the tubing at the wellhead. A mast is pivotable into slanted or vertical positions for coil tubing operation with a blowout preventer and an injector. A cradle supports and aligns an injector to the wellhead. A coil-tubing reel cartridge assembly is adapted to run coil-tubing reels. A winching facility is used to manipulate wireline equipment. A control cabin is used to managing rig activities.

U.S. Pat. No. 6,234,253, issued on May 22, 2001 to Dallas, discloses a method and apparatus for servicing a well. The apparatus has a pair of hydraulic cylinders pivotally mounted to a pair of base beams. The cylinders are moveable from a horizontal position for transportation to a vertical position for operation. In the vertical position, the cylinders flank a wellhead and are adapted to lift the wellhead and attached production tubing using a workover beam and a lifting sub. The wellhead and production tubing can be rotated during or after elevation. A motor can be mounted to the workover beam to rotate the wellhead and the tubing. A calibrated pressure gauge can be used to indicate the weight being lifted. The apparatus can be connected to a crane truck.

U.S. Pat. No. 6,264,128, issued on Jul. 24, 2001 to Shampine et al., discloses a level wind system for a coiled-tubing reel that has an arcuate guide arm extending over the upper surface of the reel, a universal joint mounted to the lower end of the arm, a guide member supported on the free end of the guide arm, a lift cylinder for raising and lowering the guide arm, a balancing cylinder for moving the guide arm laterally, and a hydraulic fluid circuit that is responsive to a position sensor and a microprocessor.

U.S. Pat. No. 6,431,286, issued on Aug. 13, 2002 to Andreychuk, discloses an injector arrangement for use in a rig that has a movable carrier, a derrick tiltably mounted to the carrier, and a trolley capable of sliding along the derrick. An injector cradle is movable along the trolley in at least a plane perpendicular to the derrick and is pivotally mountable beneath the trolley. An injector is supported at its upper end from the cradle. At least two hydraulic cylinders are supported at one end by the derrick. The cylinders are engaged at an opposed end to a lower end of the injector.

U.S. Pat. No. 6,502,641, issued on Jan. 7, 2003 to Carriere et al., discloses a hybrid apparatus for operation with both coiled tubing and sectional tubing that has a coiled-tubing rig. The rig has a frame, a mast normally aligned over a wellhead, an injector located on the mast, and a tubing straightener positioned between the injector and the wellhead. A rotary table is affixed to the wellhead for rotationally supporting tubing passing through the wellhead. A jib crane is mounted atop the mast. A mechanism pivots the mast between a first position and a second position.

It is an object of the present invention to reduce operating pressures of hydraulic cylinders connected to the boom of a pipe handling apparatus.

It is another object of the present invention to decrease the duty of hydraulic cylinders of a pipe handling apparatus.

It is another object of the present invention to reduce the peak and average horsepower requirements for pivoting a boom of a pipe handling apparatus.

It is still another object of the present invention to reduce peak cooling requirements while lowering the boom of a pipe handling apparatus.

It is another object of the present invention to reduce fuel consumption due to pivoting a boom of a pipe handling apparatus by up to seventy-five percent.

It is another object of the present invention to create negative gravity accelerations while lowering the boom of a pipe handling apparatus so as to almost "float" the boom.

It is another object of the present invention to provide extra capacity or speed in horse power of a pipe handling apparatus.

It is still another object of the present invention to increase the useful life and reliability of a pipe handling apparatus.

It is another object of the present invention to create lifting mechanisms for a boom of a pipe handling apparatus that are completely separate sub systems that have no significant impact on raising the boom or controlling the boom.

These and other objects and advantages of the present invention will become apparent from a reading of the attached specification and appended claims.

BRIEF SUMMARY OF THE INVENTION

The present invention is an apparatus for pivoting a boom relative to a frame of a pipe handling system between a first position and a second position. The apparatus includes the frame, a boom pivotally interconnected to the frame so as to be movable between the first position and the second position, a hydraulic actuating means having one end affixed to the frame and an opposite end connected to the boom so as to move the boom between the first and second positions, and a pneumatic spring means having one end affixed to the frame and an opposite end connected to the boom. The pneumatic spring means serves to urge the boom from the first position to the second position while resisting movement of the boom from the second position to the first position.

The hydraulic actuating means comprises a cylinder having one end pivotally coupled to the frame, a piston slidably received in the cylinder and extending outwardly therefrom so as to have an end pivotally coupled to the boom, and a hydraulic fluid pumping means fluidically connected to the cylinder. The hydraulic fluid pumping means serves to deliver hydraulic fluid to the cylinder so as to urge against the piston so as to move the boom from the first position to the second position.

The pneumatic spring means comprises a cylinder having one end pivotally coupled to the boom and a piston slidably received in the cylinder and extending outwardly therefrom. The piston is pivotally coupled to the frame. The piston defines a gas-containing space within the cylinder. This gas-containing space is filled with a compressible fluid. In the preferred embodiment of the present invention, the compressible fluid is a nitrogen gas. A gas-charging means is fluidically coupled to the gas-containing space so as to pass the compressible fluid into the gas-containing space.

Specifically, the hydraulic actuating means comprises a first piston-and-cylinder assembly connected adjacent one side of the frame and adjacent one side of the boom, and a second piston-and-cylinder assembly connected adjacent an opposite side of the frame and adjacent an opposite side of the boom. The pneumatic spring means is positioned between the first and second piston-and-cylinder assemblies of the hydraulic actuating means. In the preferred embodiment of the present invention, the pneumatic spring means comprises a pair of piston-and-cylinder assemblies extending in generally parallel relation to each other.

The piston defines a liquid-receiving space within the cylinder. This liquid-receiving space has a corrosion-resistant liquid therein.

In the present invention, the pipe handling system further includes a lever assembly pivotally coupled to the boom, an arm pivotally connected at one end to the first portion of the lever assembly and extending outwardly therefrom, a link pivotally connected to the second portion of the lever assembly so as to pivot at an end of the second portion opposite of the first portion so as to move relative to the movement of the boom between the first and second positions, a brace having an end pivotally connected to the boom and an opposite end pivotally connected to the arm, and a gripping means attached to an opposite end of the arm for gripping a surface of a tubular. The gripping means includes a stab frame fixedly attached to the opposite end of the arm and at least one gripper attached to a side of the stab frame opposite the arm.

In the preferred embodiment of the present invention, the frame is a skid that extends in a generally horizontal plane. The boom extends in generally parallel relation to the skid in the first position. The boom extends angularly upwardly of the skid in the second position.

DETAILED DESCRIPTION OF THE INVENTION

Figure 1:
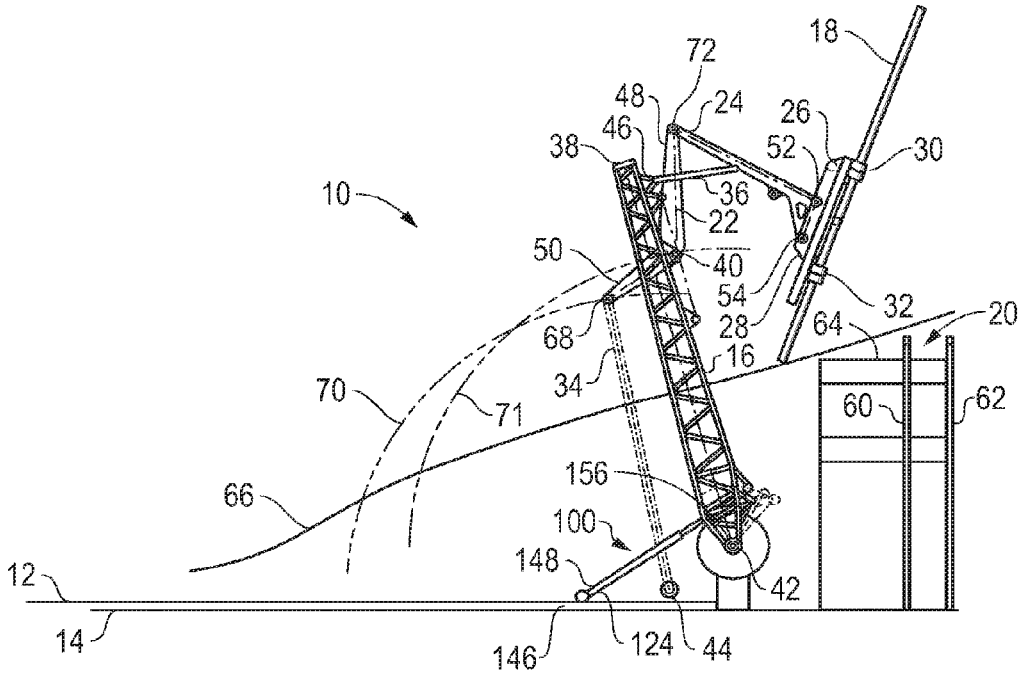
FIG. 1 shows a side elevational view of the apparatus of the present invention as used on a pipe handling system.

Referring to FIG. 1, there is shown a side elevational view of the preferred embodiment of the apparatus 100 of the present invention as used with a pipe handling system 10. The pipe handling system 10 is mounted on a frame 12 (such as a skid) that is supported upon the bed 14 of a vehicle, such as a truck. The pipe handling system 10 includes a boom 16 that is pivotally movable between a first position and a second position relative to a frame 12. In FIG. 1, an intermediate position of the pipe handling system 10 is particularly shown. In this position, the pipe 18 is illustrated in its position prior to installation on the drill rig 20. A lever assembly 22 is pivotally connected to the boom 16. An arm 24 is pivotally connected to an end of the lever assembly 22 opposite the boom 16. A gripping means 26 is fixedly connected to an opposite end of the arm 24 opposite the lever assembly 22. The gripping means 26 includes a stab frame 28 and grippers 30 and 32. A link 34 has one end pivotally connected to the frame 12 and an opposite end pivotally connected to the end of the lever assembly 22 opposite the arm 24. A brace 36 is pivotally connected to a small frame member 46 of the boom 16 and also pivotally connected to the arm 24 between the lever assembly 22 and the stab frame 28 of gripping means 26.

The apparatus 100 of the present invention extends between the boom 16 and the frame 12 of the pipe handling system 10. The second hydraulic piston-and-cylinder assembly 124 can be seen from side 146 of the frame 12. The system 10 is in an intermediate position between the first and second positions, thus the piston 156 can be seen as extending outwardly from an interior of the cylinder 148 of the second hydraulic piston-and-cylinder assembly 124. The other piston-and-cylinder assemblies and pneumatic springs are in extended positions similar to that of the second hydraulic piston-and-cylinder assembly 124. These pneumatic springs are illustrated in greater detail in FIGS. 6 and 7.

The boom 16 is a structural framework of struts, cross members and beams. In particular, the boom 16 is configured so as to have an open interior such that the pipe 18 will be able to be lifted in a manner so as to pass through the interior of the boom 16. As such, the end 38 of the boom 16 should be strongly reinforced so as to provide the necessary structural integrity to the boom 16. A lug 40 extends outwardly from one side of the boom 16. This lug 40 is suitable for pivotable connection to the lever assembly 22. The boom 16 is pivotally connected at the opposite end 42 to a location on the frame 12. The pivotable connection at end 42 of the boom 16 is located in offset relationship and above the pivotable connection 44 of the link 34 with the frame 12. A small frame member 46 extends outwardly from the side of the boom 16 opposite the link 34. This frame assembly 46 has a pivotable connection with the brace 36.

The lever assembly 22 includes a first portion 48 and a second portion 50. The first portion 48 extends at an obtuse angle with respect to the second portion 50. The link 34 is pivotally connected to the end of the second portion 50 opposite the first portion 48. The arm 24 is pivotally connected to the end of the first portion 48 opposite the second portion 50. The lug 40 of the boom 16 is pivotally connected in an area generally between the first portion 48 and the second portion 50. This unique arrangement of the lever assembly 22 facilitates the ability of the present invention to carry out the movement of the pipe 18 between the horizontal orientation and the vertical orientation.

The arm 24 has an end pivotally connected to the end of the first portion 48 of the lever assembly 22. The opposite end of the arm 24 is connected to the gripping means 26. In particular, a pair of pin connections engage a surface of the stab frame 28 of the gripping means 26 so as to fixedly position the gripping means 26 with respect to the end of the arm 24. The pin connections 52 and 54 can be in the nature of bolts, or other fasteners, so as to strongly connect the stab frame 28 of the gripping means 26 with the arm 24. The bolts associated with pin connections 52 and 54 can be removed such that other gripping means 26 can be affixed to the end of the arm 24. As such, the pipe handling system 10 is adaptable to various sizes of pipe 18 and various heights of drilling rigs 20.

The gripping means 26 includes the stab frame 28 with the grippers 30 and 32 translatable along the length of the stab frame 28. This vertical translation of the grippers 30 and 32 allows the pipe 18 to be properly moved upwardly and downwardly once the vertical orientation of the pipe 18 is achieved. The grippers 30 and 32 are in the nature of conventional grippers which can open and close so as to engage the outer diameter of the pipe 18, as desired.

The link 34 is an elongate member that extends from the pivotable connection 44 with the frame 12 to the pivotable connection 68 of the second portion 50 of the lever assembly 22. The link 34 is non-extensible and extends generally adjacent to the opposite side from the boom 16 from that of the arm 24. The link 34 will generally move relative to the movement of the boom 16. The brace 36 is pivotally connected to the small framework 46 associated with boom 16 and also pivotally connected at a location along the arm 24 between the ends thereof. Brace 36 provides structural support to the arm 24 and also facilitates the desired movement of the arm 24 during the movement of the pipe 18 between the horizontal orientation and the vertical orientation.

The drilling rig 20 is illustrated as having drill pipes 60 and 62 extending upwardly so as to have an end above the drill floor 64. When the pipe 18 is in its vertical orientation, the translatable movement of the grippers 30 and 32 can be utilized so as to cause the end of the pipe 18 to engage with the box of one of the drill pipes 60 and 62.

Referring still to FIG. 1, the general movement of the bottom end of the pipe 18 is illustrated by line 66. The movement of the pivot point 68 of the connection between the lever assembly 22 and the link 34 is illustrated by line 70. Curved line 71 illustrates the movement of the pivotable connection 40 between the boom 16 and the lever assembly 22.

The coordinated movement of each of the non-extensible members of the system 10 is achieved with proper sizing and angular relationships. In essence, the system 10 provides a four-bar link between the various components. As a result, the movement of the drill pipe 18 between a horizontal orientation and a vertical orientation can be achieved purely through the mechanics associated with the various components. As can be seen, only a single hydraulic actuator may be necessary so as to achieve this desired movement. There does not need to be coordinated movement of hydraulic actuators. The hydraulic actuators are only used for the pivoting of the boom. Since the frame 12 is a skid located on the bed of a vehicle 14, the vehicle 14 can be maneuvered into place so as to properly align with the centerline of the drill pipe 60 and 62 of the drilling rig 20. Once the proper alignment is achieved by the vehicle 14, the system 10 can be operated so as to effectively move the drill pipe to its desired position. The gripper assemblies allow the drill pipe 18 to be moved upwardly and downwardly for the proper stabbing of the drill pipes 60 and 62.

Figure 2:
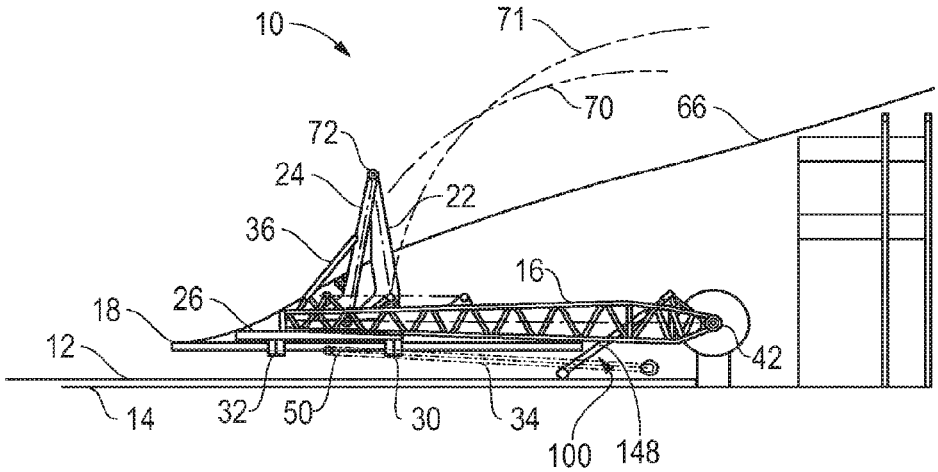
FIG. 2 shows a side elevational view of the apparatus of the present invention as used on a pipe handling system, with the system in a first position.

Referring to FIG. 2, there is shown a side elevational view of the apparatus 100 of the present invention as used on a pipe handling system 10, with the pipe handling system 10 in the first position. The drill pipe 18 is in a generally horizontal orientation. The drill pipe can be delivered to the system 10 in a position below the boom 16. In particular, the drill pipe can be loaded upon the frame 12 in a location generally adjacent to the grippers 30 and 32 associated with the gripping means 26. As such, the present invention facilitates the easy delivery of the drill pipe to the desired location. The gripper 30 and 32 grip the outer diameter of the pipe 18 in this horizontal orientation. The boom 16 resides above the drill pipe 18 and in generally parallel relationship to the top surface of the frame 12. The lever assembly 22 is suitably pivoted so that the arm 24 extends through the interior of the framework of the boom 16 and such that the gripping means 26 engages the pipe 18. The brace 36 resides in connection with the small frame member 46 of the boom 16 and also is pivotally connected to the arm 24. The link 34 resides below the boom 16 generally adjacent to the upper surface of the frame 12 and is connected to the second portion 50 of the lever assembly 22 below the boom 16.

Because the system 10 is in the first position, the piston of the second hydraulic piston-and-cylinder assembly 124 of the apparatus 100 is shown as in the retracted position, i.e. retracted within the cylinder 148 of the second hydraulic piston-and-cylinder assembly 124. The other hydraulic piston-and-cylinder assemblies and pneumatic springs (not shown) of the apparatus 100 are in similar retracted positions.

Figure 3:
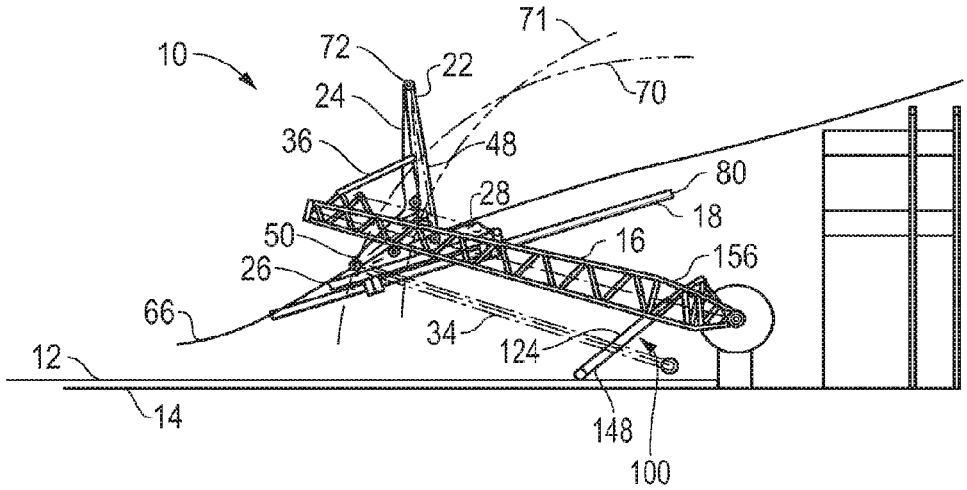
FIG. 3 shows a side elevational view of the apparatus of the present invention as used on the pipe handling system, with the pipe handling system moving from the first position toward a second position.

Referring to FIG. 3, there is shown a side elevational view of the apparatus 10 of the present invention as used on a pipe handling system 10 moving from the first position to a second position. Particularly, the system 10 is shown in an intermediate position while moving the drill pipe 18 from the horizontal orientation to the vertical orientation. As can be seen, the gripping means 26 has engaged with the pipe 18. The lever assembly 22 has pivoted so that the end 79 of pipe 18 passes through the interior of the framework of the boom 16. Also, the arm 24 associated with the gripping means 26 serves to move the stab frame 28 of the gripping means 26 through the interior of the framework of the boom 16. The brace 36 pulls on the first portion 48 of lever assembly 22. The link 34 pulls on the end of the second portion 50 of the lever assembly 22 so as to draw the first portion 48 upwardly and to cause the movement of the stab frame 28 of the gripping means 26. The apparatus 100 has operated so as to urge the boom 16 pivotally upwardly. The second piston-and-cylinder assembly 124 can be seen as extending between the frame 12 and the boom 16. The piston 156 extends slightly outwardly of the cylinder 148 of the second piston-and-cylinder assembly 124 when the system 10 is in this intermediate position. The other hydraulic piston-and-cylinder assemblies and pneumatic springs of the apparatus 100 have similar extensions to that of the second piston-and-cylinder assembly 124.

Figure 4:
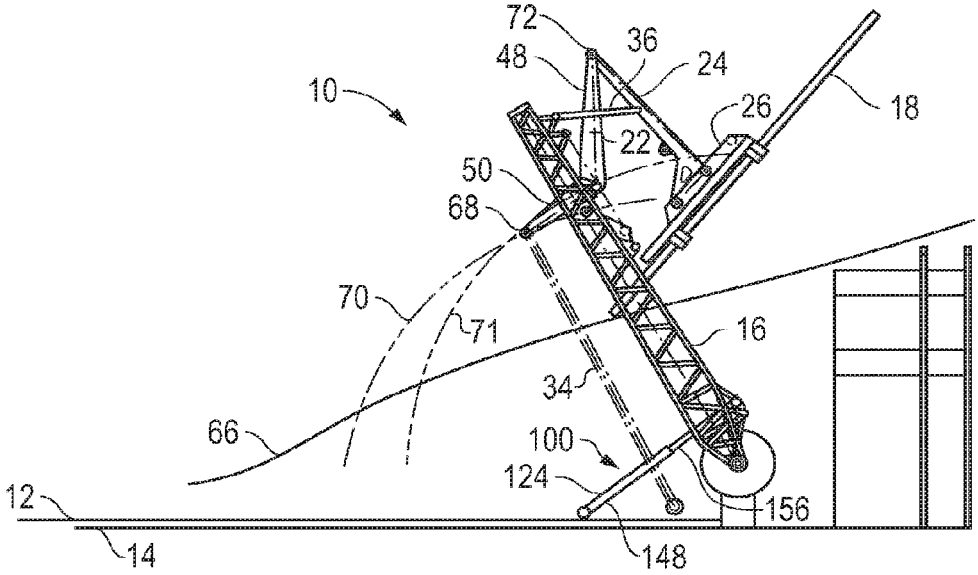
FIG. 4 shows a side elevational view of the apparatus of the present invention as used on a pipe handling system, with the pipe handling system moving further towards the second position.

Referring to FIG. 4, there is shown a side elevational view of the apparatus 10 of the present invention as used with a pipe handling system 10, with the system 10 moving further from the first position to the second position. The apparatus 100 urges the boom 16 angularly upwardly away from the top surface of the frame 12. This causes the link 34 to have a pulling force on the pivotal connection 68 of the second portion 50 of the lever assembly 22. This causes the first portion 48 of the lever assembly 22 to move upwardly thereby causing the arm 24, in combination with the brace 36 to lift the gripping means 26 further upwardly and draw the pipe 18 completely through the interior of the boom 16. The second hydraulic piston-and-cylinder assembly 124 can be seen in another intermediate position as the system 10 extends further toward the second position from the first position. The piston 156 extends even further outwardly of the cylinder 148 in FIG. 4 than in the position shown in FIG. 3. The other hydraulic piston-and-cylinder assemblies and pneumatic springs of the apparatus 100 have similar extensions to that of the second hydraulic piston-and-cylinder assembly 124.

Figure 5:
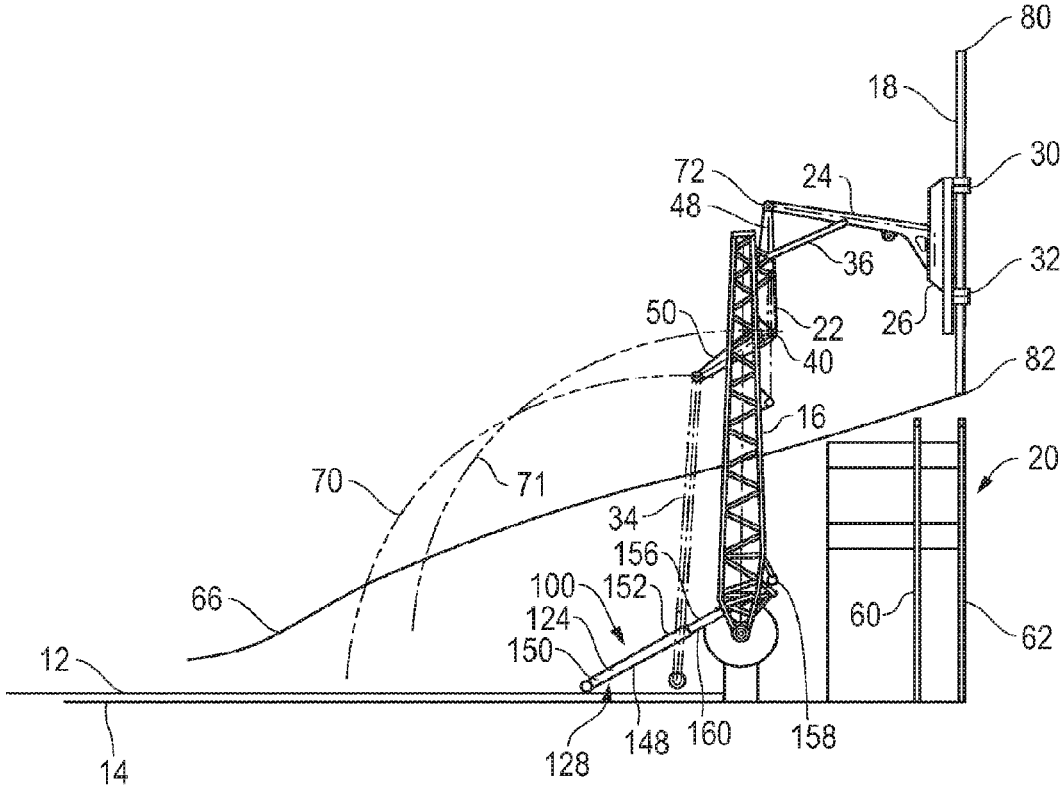
FIG. 5 shows a side elevational view of the apparatus of the present invention as used on a pipe handling system, with the pipe handling system in the second position.

Referring to FIG. 5, there is shown a side elevational view of the preferred embodiment of the present invention as used on a pipe handling system 10, with the system 10 in the second position. The drill pipe 18 is in the vertical orientation. As can be seen, the drill pipe 18 is positioned directly above the underlying pipe 62 on the drilling rig 20. The further upward pivotal movement of the boom 16 is caused by extension of the apparatus 100. This causes the link 34 to rotate and draw the end of the second portion 50 of the lever assembly 22 downwardly. The lever assembly 22 rotates about the pivot point 40 such that the first portion 48 of the lever assembly 22 has a pivot 72 at its upper end. The brace 36 is now rotated in a position so as to provide support for the arm 24 in this upper position. The gripping means 26 has grippers 30 and 32 aligned vertically and in spaced parallel relationship to each other. If any further precise movement is required between the bottom end 80 of the pipe 18 and the upper end 82 of pipe 62, then the vehicle 14 can be moved slightly so as to achieve further precise movement. In the manner described hereinbefore, the drill pipe 18 has achieved a completely vertical orientation by virtue of the interrelationship of the various components of the system 10 and apparatus 100 without the need for complex control mechanisms and hydraulics. In order to install the drill pipe 18 upon the pipe 62, it is only necessary to vertically translate the grippers 30 and 32 along the stab frame 28 of the gripping means 26. As such, the end 80 can be stabbed into the box connection 82 of pipe 62. Suitable tongs, spinners, or other mechanisms can be utilized so as to rotate the pipe 18 in order to achieve a desired connection. The grippers 30 and 32 can then be released from the exterior of the pipe 18 and returned back to the original position such that another length of drill pipe can be installed.

The second hydraulic piston-and-cylinder assembly 124 of the apparatus 100 has a piston 156 and a cylinder 148. An end 150 of the cylinder 148 is connected to the frame 12. An end 158 of the piston 156 is connected to the boom 16. When the apparatus 100 is activated, the apparatus 100 pivots the boom 16 relative to the frame 12 upwardly from the first position to the second position so as to cause the pipe 18 to achieve a vertical orientation. The first hydraulic piston-and-cylinder assembly of the hydraulic actuator 128 has a similar connection to the frame 12 and boom 16. The pneumatic springs are inverted relative to the hydraulic piston-and-cylinder assemblies 128 so that an end of the cylinder is connected to the boom 16 and an end of the piston is connected to the frame 12. The piston 156 of the second hydraulic piston-and-cylinder assembly 124 is shown in FIG. 5 as fully extended from the cylinder 148 so that the opposite end 160 of the piston 156 is adjacent the opposite end 152 of the cylinder 148. The other hydraulic piston-and-cylinder assemblies and gas springs of the apparatus 100 have similar extensions to that of the second hydraulic piston-and-cylinder assembly 124.

Figure 6:
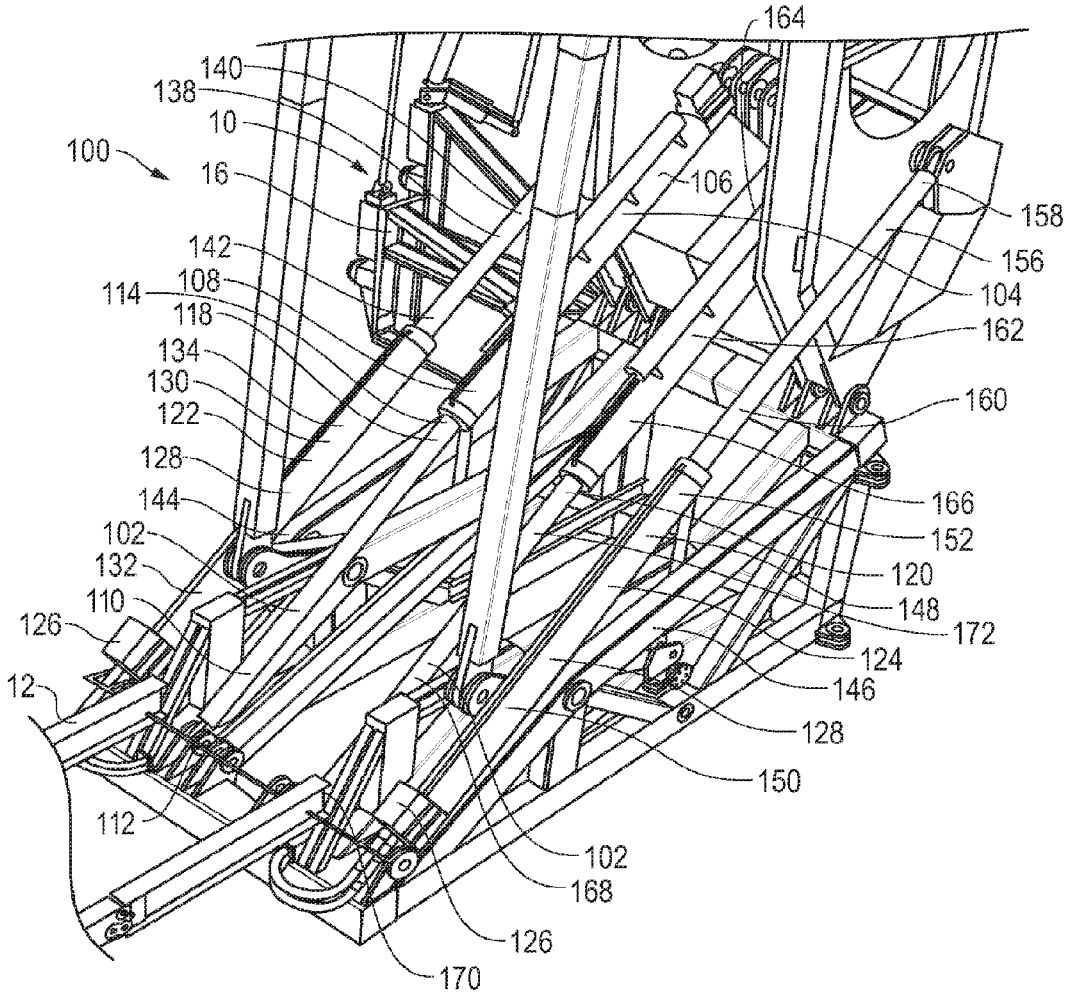
FIG. 6 shows an isolated plan perspective view of the preferred embodiment of the apparatus of the present invention.

Referring to FIG. 6, there is shown an isolated plan perspective view of the preferred embodiment of the apparatus 100 of the present invention as used on a pipe handling system 10. The system 10 is shown in the second position, with the apparatus 100 in an extended position. The apparatus 100 pivots the boom 16 of the system 10 between the first and second positions. The apparatus 100 has hydraulic piston-and-cylinder assemblies 128 connected to the boom 16 and frame 12, and pneumatic springs 102 connected to the boom 16 and frame 12.

Each of the pneumatic springs 102 has a piston and a cylinder. The first pneumatic spring 118 has a cylinder 104 that has an end 106 pivotally connected to the boom 16, and a piston 110 movably positioned within an interior of the cylinder 104. The piston 110 has an end 112 pivotally connected to the frame 12. The second pneumatic spring 120 has a cylinder 162 that has an end 164 pivotally connected to the boom 16, and a piston 168 movably positioned within an interior of the cylinder 162. The piston 168 has an end 170 pivotally connected to the skid 12. The interior of the cylinders 104 and 162 may be filled with nitrogen gas. An opposite end 114 of the piston 110 of the first pneumatic spring 118 extends within the interior of the cylinder 104 of the first pneumatic spring 118 adjacent the boom 16 when the boom 16 is in the first position. An opposite end 172 of the piston 168 of the second pneumatic spring 120 extends within the interior of the cylinder 162 of the second pneumatic spring 120 adjacent the boom 16 when the boom 16 is in the first position. An opposite end 114 of the piston 110 of the first pneumatic spring 118 extends within the interior of the cylinder 104 of the first pneumatic spring 118 adjacent an opposite end 108 of the cylinder 104 when the boom 16 is in the second position. An opposite end 172 of the piston 168 of the second pneumatic spring 120 extends within the interior of the cylinder 162 of the second pneumatic spring 120 adjacent an opposite end 166 of the cylinder 162 when the boom 16 is in the second position.

Each of the hydraulic piston-and-cylinder assemblies 128 has a piston and a cylinder. The first hydraulic piston-and-cylinder assembly 122 has a cylinder 130 having an end 132 pivotally connected to the frame 12, and a piston 138 movably positioned within an interior of the cylinder 130. The piston 138 has an end 140 pivotally connected to the boom 16. The second hydraulic piston-and-cylinder assembly 124 has a cylinder 148 having an end 150 pivotally connected to the frame 12, and a piston 156 movably positioned within an interior of the cylinder 148. The piston 156 has an end 158 pivotally connected to the boom 16. An opposite end 142 of the piston 138 of the first hydraulic piston-and-cylinder assembly 122 extends within an interior of the cylinder 130 of the first hydraulic piston-and-cylinder assembly 122 adjacent the frame 12 when the boom 16 is in the first position. An opposite end 160 of the piston 156 of the second hydraulic piston-and-cylinder assembly 124 extends within an interior of the cylinder 148 of the second hydraulic piston-and-cylinder assembly 124 adjacent the frame 12 when the boom 16 is in the first position. The opposite end 142 of the piston 138 of the first hydraulic piston-and-cylinder assembly 122 extends within the interior of the cylinder 130 adjacent an opposite end 134 of the cylinder 130 when the boom 16 is in the second position. The opposite end 160 of the piston 156 of the second hydraulic piston-and-cylinder assembly 124 extends within the interior of the cylinder 148 adjacent an opposite end 152 of the cylinder 148 when the boom 16 is in the second position.

The hydraulic powering means 126 is operatively connected to the first and second hydraulic piston-and-cylinder assemblies 122 and 124. The hydraulic powering means 126 pumps hydraulic fluid into and out of the interiors of the cylinders 130 and 148 of the hydraulic piston-and cylinder assemblies 122 and 124 so as to cause the pistons 138 and 156 to extend and retract from the interiors of the cylinders 130 and 148. The extension and retraction of the pistons 138 and 156 pivots the boom 16 relative to the skid 12 between the first and second positions. Suitable lines are connected between the hydraulic powering means 126 and cylinders 130 and 148 to allow fluid to travel therebetween.

Referring still to FIG. 6, it can be seen that the first and second pneumatic springs 118 and 120 are inverted so that the cylinders 104 and 162 are connected to the boom 16 while the pistons 110 and 168 are connected to the frame 12. Having the pneumatic springs 118 and 120 in this orientation gives extra pushing force when moving the boom 16 from the first position to the second position, and gives extra braking force when moving the boom 16 from the second position to the first position. Thus, the power band requirement of the first and second hydraulic piston-and-cylinder assemblies 122 and 124 are reduced by the addition of pneumatic springs 118 and 120 in the apparatus 100. The peak and total operating pressures of the hydraulic fluid in the cylinders 130 and 148 of the hydraulic piston-and-cylinder assemblies 122 and 124 are thus reduced by the use of pneumatic springs 118 and 120. Because less hydraulic pressure is required for the hydraulic piston-and-cylinder assemblies 122 and 124, the horsepower requirements of a pump of the hydraulic powering means 126 are reduced. The consumption of fuel of hydraulic powering means 126 is reduced by up to 75%. Because lower pressures are used on the hydraulic piston-and-cylinder assemblies 122 and 124, there is less wear and tear and thus prolonged operative life of the assemblies 122 and 124. The apparatus 100 with pneumatic springs 118 and 120 allows the energy saved to be used on other components of the pipe handling system 10, if desired. Thus, additional power supplies do not have to be purchased with use of the apparatus 100 of the present invention.

The pneumatic springs 118 and 120 are separate from the hydraulic system of the piston-and-cylinder assemblies 122 and 124. Thus, a failure in the hydraulic piston-and-cylinder assemblies 122 and 124 does not cause a failure in the pneumatic springs 118 and 120, and vice versa. The pneumatic springs 118 and 120 provide upward forces on the boom 16 as the boom 16 moves from the second position to the first position (and vice versa) so as to counter the acceleration of the boom 16 by gravity, thus "floating" the boom 16 downwardly from the second position to the first position. This "floating" makes the movement of the boom 16 safer for personnel in the vicinity of the boom and helps prevent the boom from moving too quickly and/or colliding with the frame 12 when reaching the first position.

Figure 7:
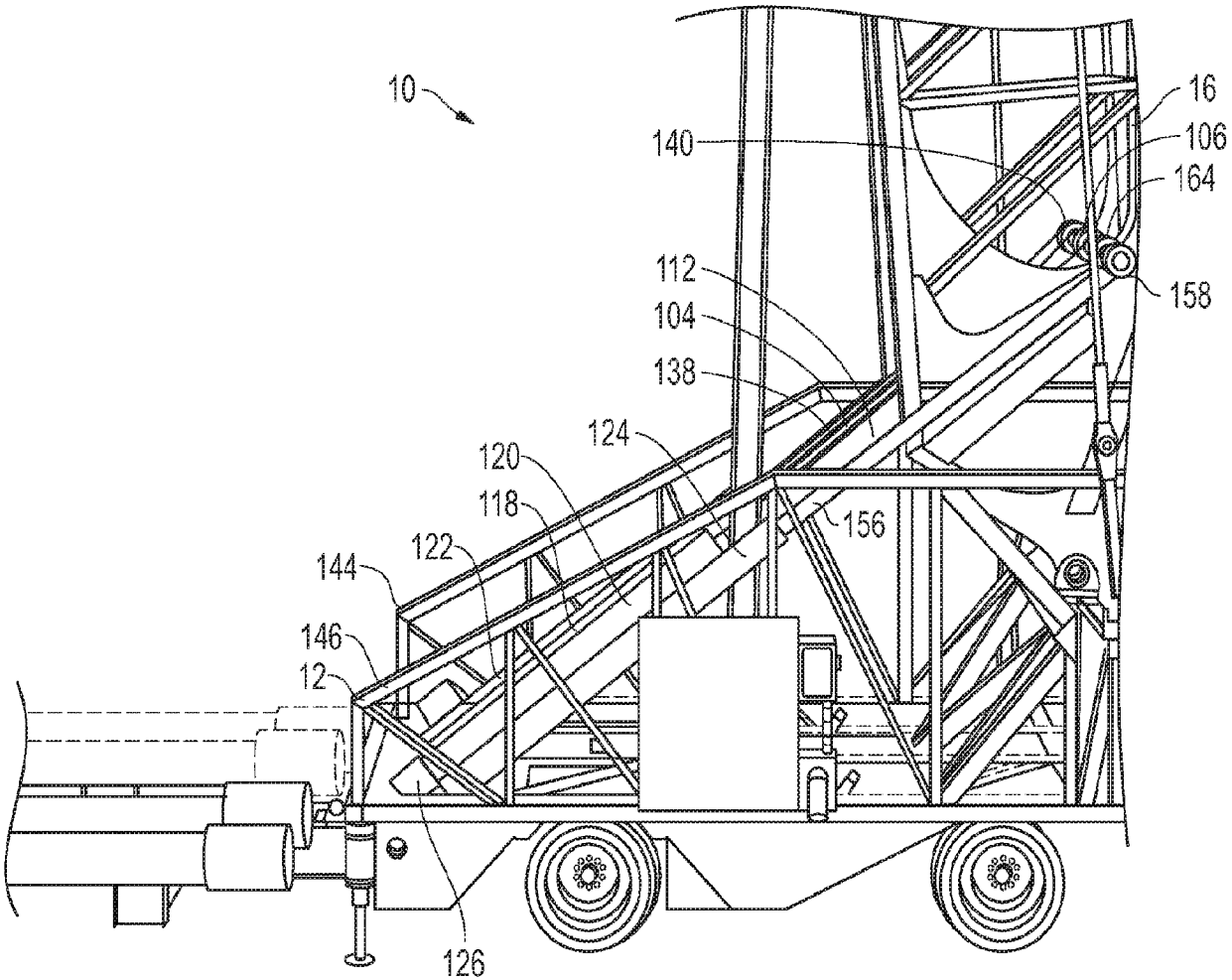
FIG. 7 shows a side perspective view of the preferred embodiment of the apparatus of the present invention.

Referring to FIG. 7, there is shown a side perspective view of the apparatus 100 of the present invention as used on a pipe handling system 10. The end 158 of the piston 156 of the second hydraulic piston-and-cylinder assembly 124 can be seen pivotally connected to the boom 16. The end 164 of the cylinder 162 of the second pneumatic spring 120 can be seen pivotally connected to the boom 16. The end 106 of the cylinder 104 of the first pneumatic spring 118 can be seen pivotally connected to the boom 16. The end 140 of the piston 138 of the first piston-and-cylinder assembly 122 can be seen pivotally connected to the boom 16. The first hydraulic piston-and-cylinder assembly 122 is positioned adjacent the side 144 of the frame 12. The second hydraulic piston-and-cylinder assembly 124 is positioned adjacent the opposite side 146 of the frame 12. The first pneumatic spring 118 is positioned between the first and second hydraulic piston-and-cylinder assemblies 122 and 124 adjacent the side 144 of the frame 12. The second pneumatic spring 120 is positioned adjacent the opposite side 146 of the frame 12 between the first and second hydraulic piston-and-cylinder assemblies 122 and 124. The frame 12 is shown with sides 144 and 146, which is a structural framework suitable for housing the rest of the pipe handling system 10.

The foregoing disclosure and description of the invention is illustrative and explanatory thereof. Various changes in the details of the illustrated construction can be made within the scope of the appended claims without departing from the true spirit of the invention. The present invention should be limited only by the following claims and their legal equivalents.

We claim:

1. An apparatus comprising:
- a frame;
- a boom pivotally connected to the frame, the boom being movable between a first position and a second position;
- a lever pivotally connected to the boom, and having a first portion extending outwardly with respect to a second portion;
- an arm pivotally connected at one end to the first portion of the lever and extending outwardly therefrom;
- a gripping assembly attached to an opposite end of the arm for gripping a surface of a tubular;
- a link pivotally connected at one end to the second portion of the lever and an opposite end pivotally connected to the frame;
- a brace having an end pivotally connected to the boom and an opposite end pivotally connected to the arm;
- a hydraulic actuating assembly having one end affixed to the frame and an opposite end connected to the boom, the hydraulic actuating assembly for moving the boom between the first and second positions; and
- a pneumatic spring assembly having one end affixed to the frame and an opposite end connected to the boom, the pneumatic spring assembly for urging the boom from the first position to the second position and for resisting movement of the boom from the second position to the first position.

2. The apparatus of claim 1, the hydraulic actuating assembly comprising:
- a cylinder having one end pivotally connected to the frame;
- a piston slidably received in the cylinder and extending outwardly therefrom, the piston having an end pivotally connected to the boom; and
- a hydraulic fluid pumping assembly fluidically connected to the cylinder, the hydraulic fluid pumping assembly for delivering and receiving hydraulic fluid to the cylinder so as to urge against the piston so as to move the boom between the first and second positions.

3. The apparatus of claim 2, the hydraulic actuating assembly further comprising:
- a first piston-and-cylinder assembly connected adjacent one side of the frame and adjacent one side of the boom; and
- a second piston-and-cylinder assembly connected adjacent an opposite side of the frame and adjacent one side of the boom.

4. The apparatus of claim 3, the pneumatic spring assembly positioned between the first and second piston-and-cylinder assemblies.

5. The apparatus of claim 4, the pneumatic spring assembly comprising:
- a pair of piston-and-cylinder assemblies extending in generally inverted relation to the hydraulic actuating assembly.

6. The apparatus of claim 4, the pneumatic spring assembly comprising:
- a pair of piston-and-cylinder assemblies extending in generally parallel relation to each other.

7. The pipe handling apparatus of claim 6, the pneumatic spring assembly extending in generally parallel relation to the hydraulic actuating assembly.

8. The apparatus of claim 1, the pneumatic spring assembly comprising:

a cylinder having one end pivotally connected to the boom; and a piston slidably received in the cylinder and extending outwardly thereof, the piston being pivotally connected to the frame.

9. The apparatus of claim 8, the piston defining a gas-containing space within the cylinder, the gas-containing space being filled with a compressible fluid.

10. The apparatus of claim 9, the compressible fluid being a nitrogen gas.

11. The apparatus of claim 9, further comprising:

a gas-charging assembly fluidically connected to the gas-containing space, the gas-charging assembly for passing the compressible fluid into the gas-containing space.

12. The apparatus of claim 9, the piston of the pneumatic spring assembly further defining a liquid-receiving space within the cylinder, the liquid-receiving space having a corrosion-resistant liquid therein.

13. The apparatus of claim 1, the gripping assembly comprising:

a stab frame fixedly attached to the opposite end of the arm; and at least one gripper attached to a side of the stab frame opposite the arm.

14. The apparatus of claim 1, the frame being a skid extending in a generally horizontal plane, the boom extending in generally parallel relation to the skid in the first position, the boom extending angularly upwardly of the skid in the second position.

15. A pipe handling apparatus comprising:

a frame;

a boom pivotally connected to the frame, the boom being movable between a first position and a second position;

a lever pivotally connected to the boom, and having a first portion extending outwardly with respect to a second portion;

an arm pivotally connected at one end to the first portion of the lever and extending outwardly therefrom;

a gripping assembly attached to an opposite end of the arm for gripping a surface of a tubular;

a hydraulic actuating assembly having one end connected to the frame and an opposite end connected to the boom, the hydraulic actuating assembly for moving the boom between the first and second positions, the hydraulic actuating assembly further comprising:

a first piston-and-cylinder assembly connected adjacent one side of the frame and adjacent one side of the boom; and a second piston-and-cylinder assembly connected adjacent an opposite side of the frame and adjacent an opposite side of the boom;

a pneumatic spring assembly positioned between the first and second piston-and-cylinder assemblies of the hydraulic actuating assembly, the pneumatic spring assembly for urging the boom from the first position to the second position and for resisting movement of the boom from the second position to the first position, the pneumatic spring assembly further comprising:

a pair of piston-and-cylinder assemblies having a piston end pivotally connected to the frame, and a cylinder end pivotally connected to the boom, the pair of pistons being slidably received in the cylinders and extending outwardly thereof, the pistons each defining a gas-containing space filled with a compressible fluid within the cylinders; and a gas-charging assembly fluidically connected to the gas-containing space, the gas-charging assembly for passing the compressible fluid into the gas-containing space.

16. The apparatus of claim 15, the hydraulic actuating assembly further comprising a hydraulic fluid pumping assembly fluidically connected to the first and second piston-and-cylinder assemblies, the hydraulic fluid pumping assembly for delivering and receiving hydraulic fluid to the cylinders so as to urge against the piston so as to move the boom between the first and second positions.

17. The apparatus of claim 15, the compressible fluid being a nitrogen gas.

18. The apparatus of claim 17, the pistons of the pneumatic spring assembly further defining a liquid-receiving space within the cylinders of the pneumatic spring assembly, the liquid-receiving space having a corrosion-resistant liquid therein.

19. The apparatus of claim 15, the cylinder end of the piston-and-cylinder assemblies of the hydraulic actuating assembly pivotally connected to the frame, the piston end pivotally connected to the boom.

20. The apparatus of claim 15, the first and second piston-and-cylinder assemblies of the hydraulic actuating assembly extending in generally parallel relation to each other.

21. The apparatus of claim 15, the pistons and cylinders of the pneumatic spring assembly extending in generally parallel relation to each other.

22. The apparatus of claim 15, the hydraulic actuating assembly and pneumatic spring assembly extending in generally parallel relation to each other.

23. The apparatus of claim 15, the gripping assembly comprising:

a stab frame fixedly attached to the opposite end of the arm; and at least one gripper attached to a side of the stab frame opposite the arm.

24. The apparatus of claim 15, the frame being a skid extending in a generally horizontal plane, the boom extending in generally parallel relation to the skid in the first position, the boom extending angularly upwardly of the skid in the second position.

* * * * *